US007579291B2

(12) United States Patent
Eagles

(10) Patent No.: US 7,579,291 B2
(45) Date of Patent: Aug. 25, 2009

(54) BICOMPONENT MONOFILAMENT

(75) Inventor: Dana Eagles, Sherborn, MA (US)

(73) Assignee: Albany International Corp., Albany, NY (US)

( * ) Notice: Subject to any disclaimer, the term of this patent is extended or adjusted under 35 U.S.C. 154(b) by 0 days.

(21) Appl. No.: 12/115,097

(22) Filed: May 5, 2008

(65) Prior Publication Data

US 2008/0207072 A1 Aug. 28, 2008

Related U.S. Application Data

(60) Continuation of application No. 11/973,503, filed on Oct. 9, 2007, which is a division of application No. 10/334,168, filed on Dec. 30, 2002, now abandoned.

(51) Int. Cl.
*D03D 15/00* (2006.01)
*D02G 3/00* (2006.01)

(52) U.S. Cl. ..... 442/192; 442/189; 442/195; 442/197; 428/375; 428/397

(58) Field of Classification Search ..... 428/373–376, 428/397, 398; 442/189, 192, 195, 197; 139/383 A, 139/420 R See application file for complete search history.

(56) References Cited

U.S. PATENT DOCUMENTS

| | | | | | |
|---|---|---|---|---|---|
| 3,458,390 | A * | 7/1969 | Tanaka et al. | ..... | 428/373 |
| 4,216,257 | A | 8/1980 | Schams et al. | | |
| 4,457,973 | A * | 7/1984 | Matsui et al. | ..... | 428/372 |
| 4,633,596 | A | 1/1987 | Josef | | |
| 4,796,749 | A * | 1/1989 | Lefferts | ..... | 198/851 |
| 5,087,519 | A * | 2/1992 | Yamaguchi et al. | ..... | 428/373 |
| 5,097,872 | A | 3/1992 | Laine et al. | | |
| 5,361,808 | A | 11/1994 | Bowen, Jr | | |
| 5,617,903 | A | 4/1997 | Bowen, Jr. | | |
| 5,744,236 | A | 4/1998 | Rohrbach et al. | ..... | 428/372 |
| 5,753,085 | A * | 5/1998 | FitzPatrick | ..... | 162/358.4 |
| 5,783,503 | A * | 7/1998 | Gillespie et al. | ..... | 442/340 |
| 5,829,488 | A | 11/1998 | Fagerholm et al. | | |
| 5,888,915 | A | 3/1999 | Denton et al. | | |
| 5,998,310 | A | 12/1999 | Bowen, Jr. | | |
| 6,093,491 | A * | 7/2000 | Dugan et al. | ..... | 428/397 |
| 6,124,015 | A | 9/2000 | Baker et al. | | |
| 6,372,068 | B1 | 4/2002 | Kincel et al. | | |
| 6,844,063 | B2 * | 1/2005 | Matsui et al. | ..... | 428/370 |
| 2004/0043207 | A1 * | 3/2004 | Donovan et al. | ..... | 428/304.4 |
| 2004/0261883 | A1 * | 12/2004 | Harrison | ..... | 139/383 A |

FOREIGN PATENT DOCUMENTS

| | | |
|---|---|---|
| WO | WO 01/21884 | 3/2001 |
| WO | WO 03/004736 | 1/2003 |

* cited by examiner

*Primary Examiner*—Jenna-Leigh Johnson
(74) *Attorney, Agent, or Firm*—Frommer Lawrence & Haug LLP; Ronald R. Santucci

(57) ABSTRACT

In one embodiment, a fabric comprises a plurality of functional monofilaments shaped to provide anchoring of a coating applied to the fabric and exhibits improved resistance to peeling away of the coating from the fabric. The second embodiment is a fabric comprised of a plurality of bicomponent monofilaments having a first component with at least one receptacle containing a second component, and the fabric exhibiting improved gripping compared to fabric constructed of conventional monofilaments. Methods for making the monofilaments and fabrics are also described.

7 Claims, 3 Drawing Sheets

Monofilament cross section without coating showing at least one cavity as an anchor for the coating Monofilament cross section with aerogrip coating Monofilament cross section without coating showing at least one cavity as an anchor for the coating Monofilament cross section with aerogrip coating

BICOMPONENT MONOFILAMENT

CROSS-REFERENCE TO RELATED APPLICATIONS

This application is a continuation of U.S. patent application Ser. No. 11/973,503 filed Oct. 9, 2007 entitled "Bicomponent Monofilament" which is a division of U.S. patent application Ser. No. 10/334,168 filed Dec. 30, 2002, now abandoned entitled "Bicomponent Monofilament", the disclosures of which are hereby incorporated by reference.

BACKGROUND OF THE INVENTION

1. Field of the Invention

The present invention relates to the papermaking arts. More specifically, the present invention relates to a dryer fabric, although it may find application in any of the fabrics used in the forming, pressing and drying sections of a paper machine, and in industrial process fabrics generally. Industrial process fabrics referred to herein may include those used in the production of, among other things, wetlaid products such as paper, paper board, corrugated paper board, and sanitary tissue and towel products; in the production of tissue and towel products made by through-air drying processes; in the production of wetlaid and drylaid pulp; in processes related to papermaking such as those using sludge filters, and chemiwashers; and in the production of nonwovens produced by hydroentangling (wet process), meltblowing, spunbonding, and airlaid needle punching. Such industrial process fabrics include, but are not limited to nonwoven fabrics; embossing, conveying, and support fabrics used in processes for producing nonwovens; and filtration fabrics and filtration cloths.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

Contemporary fabrics are produced in a wide variety of styles designed to meet the requirements of the paper machines on which they are installed for the paper grades being manufactured. Generally, they comprise a woven or other type base fabric. Additionally, as in the case of fabrics used in the press section, the press fabrics have one or more base fabrics into which has been needled a batt of fine, nonwoven fibrous material. The base fabrics may be woven from monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing at least one base fabric within the endless loop formed by another, and by needling a staple fiber batt through these base fabrics to join them to one another as in the case of press fabrics. One or more of these woven base fabrics may be of the on-machine-seamable type. This is now a well known laminated press fabric with a multiple base support structure.

In any event, the fabrics are in the form of endless loops, or are seamable into such forms, having a specific length, measured longitudinally therearound, and a specific width, measured transversely thereacross.

Referring, now, more specifically to the dryer section, dryer cylinders are typically arranged in top and bottom rows or tiers. Those in the bottom tier are staggered relative to those in the top tier, rather than being in a strict vertical relationship. As the paper sheet being dried proceeds through the dryer section, it alternates between the top and bottom tiers by passing first. around a dryer cylinder in one of the two tiers, then around a dryer cylinder in the other tier, and so on sequentially through the dryer section.

In many dryer sections, the top and bottom tiers of dryer cylinders are each clothed with a separate dryer fabric. In dryer sections of this type, the paper sheet being dried passes unsupported across the space, or "pocket", between the dryer cylinders of one tier and the dryer cylinders of the other tier.

As machine speeds are increased, the paper sheet being dried tends to flutter when passing across the pocket and often breaks. The resulting need to shut down the entire paper machine, and then to rethread the paper sheet through the dryer section, has an adverse impact on production rates and efficiency.

In order to increase production rates while minimizing disturbance to the paper sheet, single-run dryer sections are used to transport the paper sheet being dried at higher speeds than could be achieved in traditional dryer sections. In a single-run dryer section, a single dryer fabric follows a serpentine path sequentially about the dryer cylinders in the top and bottom tiers. As such, the paper sheet is guided, if not actually supported, across the pocket between the top and bottom tiers.

It will be appreciated that, in a single-run dryer section, the dryer fabric holds the paper sheet being dried directly against the dryer cylinders in one of the two tiers, but carries it around the dryer cylinders in the other tier. Alternatively, a single-run dryer section may have only one tier of dryer cylinders. Such a section has a turning roll, which may be smooth, grooved, or be provided with suction means, in the pocket between each pair of cylinders. This kind of dryer section is known as a single-tier dryer section.

Air carried along by the backside surface of the moving dryer fabric forms a compression wedge in the narrowing space where the moving dryer fabric approaches a dryer cylinder or turning roll. The resulting increase in air pressure in the compression wedge causes air to flow outwardly through the dryer fabric. This air flow, in turn, can force the paper sheet away from the paper contacting surface of the dryer fabric, a phenomenon known as "drop off", when the paper sheet is not between the dryer fabric and the dryer cylinder. "Drop off" can reduce the quality of the paper product being manufactured by causing edge cracks, and can also reduce machine efficiency if it leads to sheet breaks.

Many paper mills have addressed this problem by machining grooves into the turning rolls with which the single-tier dryer fabric comes directly into contact or by adding a vacuum source to those turning rolls. Both of these expedients allow the air otherwise trapped in the compression wedge to be removed without passing through the dryer fabric.

In this connection, fabric manufacturers have also employed application of coatings to fabrics to impart additional functionality to the fabric, such as "sheet restraint methods." The importance of applying coatings as a method for adding this functionality to, for example, dryer fabrics, has been cited by Luciano-Fagerholm (U.S. Pat. No. 5,829,488 (Albany), titled, "Dryer Fabric With Hydrophilic Paper Contacting Surface"). Luciano and Fagerholm have demonstrated the use of a hydrophilic surface treatment of fabrics to impart sheet-holding properties while maintaining close to the original permeability. However, this method of treating fabric surfaces, while successful in imparting sheet restraint, enhanced durability of the coating is desired. Thus, there stands a need to improve the wear properties of such coatings.

Turning now to the yarns used heretofore, particularly for dryer fabrics, monofilament yarns have typically been extruded with a simple circular cross-section. More recently, monofilaments with shaped cross-section have been produced. These shaped monofilaments have been used in woven fabrics to modify the fabric surface texture or density, or in particular, to control the fabric air permeability. The prior art includes U.S. Pat. No. 4,633,596 (Albany) which shows an inverted U-shaped polyester monofilament to be used in the fabrication of a forming wire to produce a desired smooth surface. However no filling of the opening to form a bicomponent filament is addressed. U.S. Pat. No. 5,097,872 uses an X-configuration cross-sectional monofilament in the machine direction yarns of a papermaking dryer fabric. In the weaving process, this monofilament is deformed to produce a smooth surface on the exposed paper side of the fabric while at the same time stability enhancing ridges are formed on the rear sides of these yarns. U.S. Pat. No. 4,216,257 refers to a U-shaped monofilament. The term "U-shaped" in this patent refers to the longitudinal, rather than the cross-sectional, shape of the monofilament. There are at least three Minnesota Mining and Manufacturing patents addressing this concept. U.S. Pat. No. 5,361,808 discloses yarns that are finned or T-shaped used as weft yarns. Note that the use of such yarns is said to broaden the permeability range. U.S. Pat. No. 5,998,310 shows monofilaments of a variety of cross-sections which may be distorted in the weaving process to achieve a number of effects. "Y" and "X" and "T" shaped monofilaments are described, but there is no mention of a U-shaped cross-section. U.S. Pat. No. 6,372,068 describes a thermoplastic monofilament bonded to a flat ribbon-like substrate to form a twist-tie for packages. U.S. Pat. No. 6,124,015 shows shaped portions of yarns for interlocking with each other.

Of particular interest is U.S. Pat. No. 5,888,915 (Albany) relating to fabrics constructed of bicomponent fibers. The bicomponent fibers have sheath and core materials with different melting points. When heated, the sheath/core yarns form a fused fabric structure which exhibits improved resistance to abrasion and also increased durability. None of the prior art however uses monofilaments having a U-shape which provides a receptacle for TPU, or which locks in or anchors a coating. All of the above referenced patents are however incorporated herein by reference.

SUMMARY OF THE INVENTION

In one embodiment, the present invention is a U-shaped bicomponent monofilament fiber using a polyester U-shaped monofilament with a thermoplastic polyurethane ("TPU") insert melt bonded in the pocket of the "U". The bicomponent monofilament may be incorporated into a papermaking fabric so that the TPU component is exposed on the paper side of the fabric. The TPU provides gripping qualities that improve sheet restraint and sheet guiding during papermaking. In a second embodiment, the invention is shaped monofilament fiber. The monofilament has a cavity that is wider at its bottom than at its open top. A coating or a melt-bonded TPU insert filling the cavity is thereby locked in place by the narrow opening of the cavity. The anchored coating has an extended life due to its greater resistance to peeling. The two embodiments of the present invention will now be described in more complete detail with reference being made to the figures identified below.

DETAILED DESCRIPTION OF THE PREFERRED EMBODIMENTS

Figures 1A, 1B, 1C, 1D, 1E:
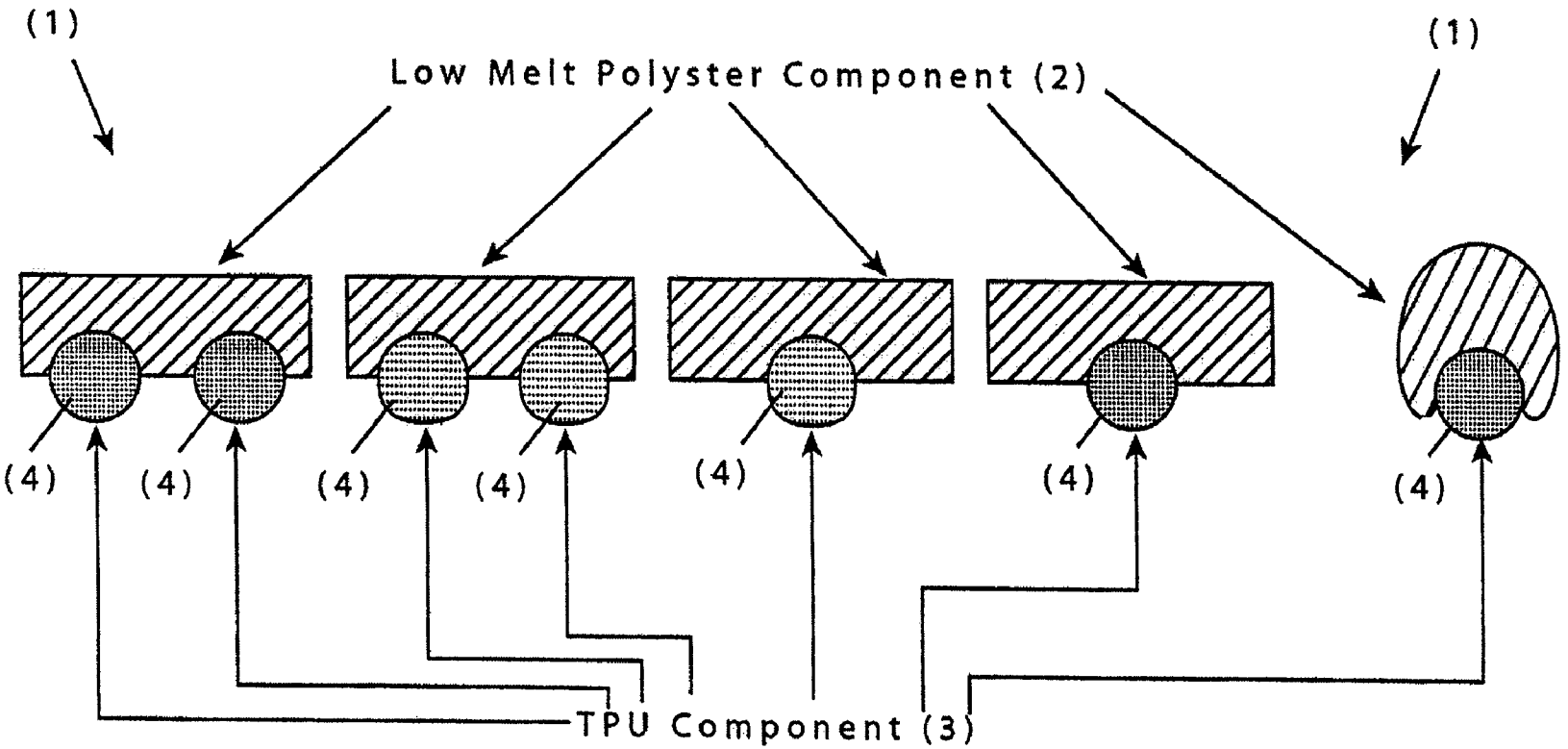
FIGS. 1A-1E are cross sectional views of a first embodiment of the monofilaments of the present invention.

A preferred embodiment of the present invention will be described in the context of a papermaking dryer fabric. However, it should be noted that the invention is applicable to the fabrics used in other sections of a paper machine, as well as to those used in other industrial settings where guiding or restraint of the product being manufactured are of importance. Some examples of other fabric types to which the invention is applicable include papermaker's forming and press fabrics, through-air-drying (TAD) fabrics and pulp forming fabrics. Another example is of fabrics used in related-to-papermaking-processes such as sludge filters and chemi-washers. Yet another example of a fabric type to which the invention is applicable is engineered fabrics, such as fabrics used in making nonwoven textiles in the wetlaid, drylaid, meltblown and/or spunbonding processes.

Fabric constructions include woven, spiral wound, knitted, extruded mesh, spiral-link, spiral coil, and other nonwoven fabrics. These fabrics may also include monofilament, plied monofilament, multifilament or plied multifilament yarns, and may be single-layered, multi-layered or laminated. The yarns are typically extruded from any one of the synthetic polymeric resins, such as polyamide and polyester resins, used for this purpose by those of ordinary skill in the industrial fabric arts.

A preferred embodiment of the bicomponent monofilament fiber 1 of the present invention is illustrated in FIGS. 1A-1E (cross-sectional view). The bicomponent monofilaments 1 are incorporated into a fabric and provide the fabric with improved gripping qualities. In the preferred embodiment, the bicomponent monofilament 1 has a polyester component 2 and a TPU component 3. The TPU component 3 may be an insert or core which is embedded or inserted into the polyester component 2. The polyester component 2 may be a U-shaped low melt polyester monofilament constituting a sheath. The sheath may be melt bonded to the TPU core component 3, as later explained. In the embodiment shown in FIGS. 1A-1E, the polyester monofilament 2 has one or more U-shaped channels 4. However, channels having other shapes, such as a C-shape, may be used. The polyester monofilament 2 can take on a variety of shapes and sizes including square, rectangular, oblong or any other shape suitable for the purpose. Into the U-shaped channel(s) 4 are physically inserted the TPU component 3. The TPU component 3 can take on a variety of shapes and sizes. For example, in FIGS. 1A and 1D, the TPU components 3 are round, whereas in FIGS. 1B and 1C the TPU components 3 are flatter and less rounded.

Figure 2:
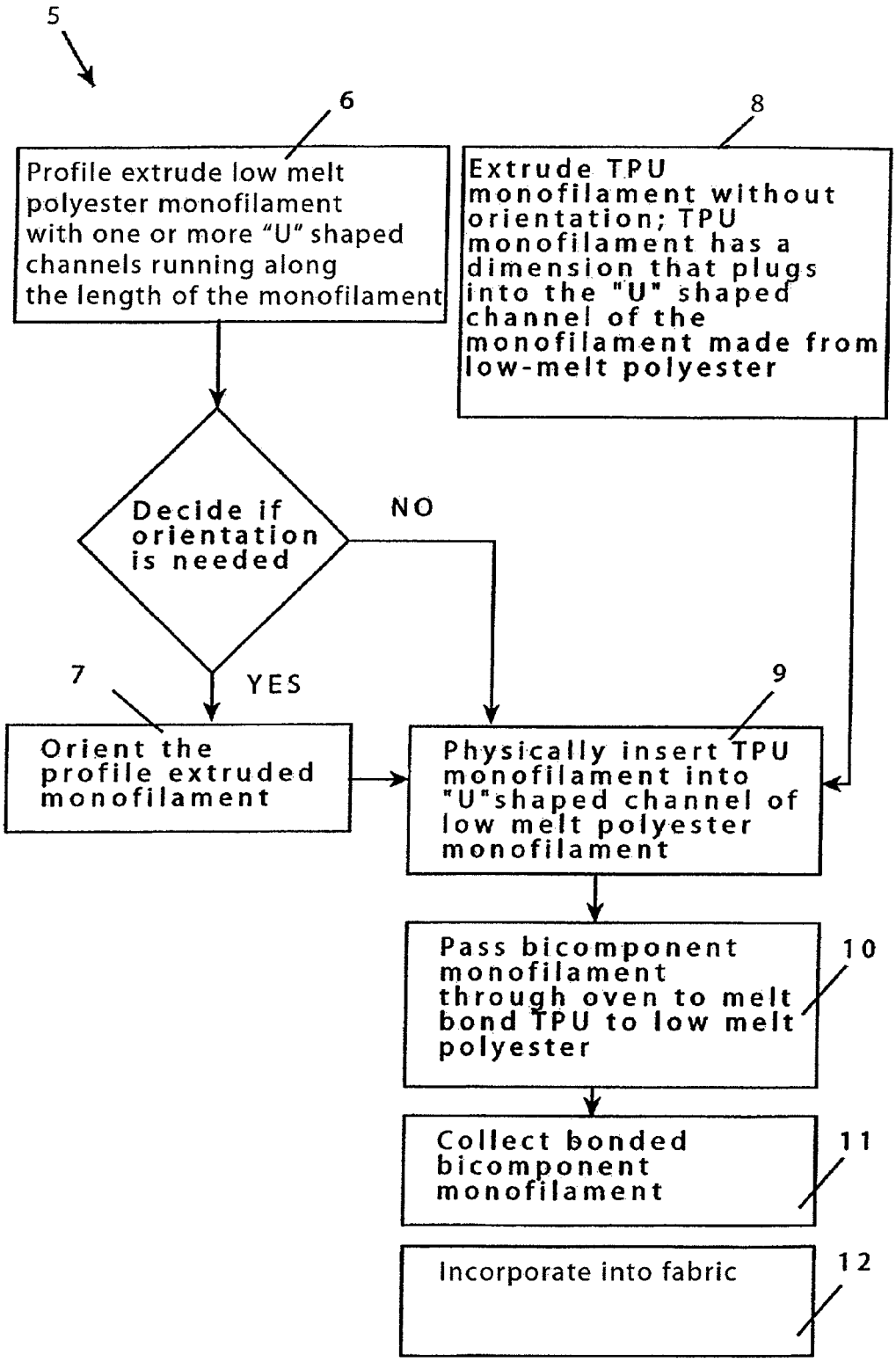
FIG. 2 is a flow chart outlining a method for making the monofilaments of the invention.

One method 5 of making the bicomponent monofilaments and the fabrics comprised thereof is set forth in the flow chart of FIG. 2. In this regard, box 6 illustrates a step of profile extruding a low melt polyester (stabilized with carbodiimide, for example) into monofilament having one or more U-shaped channels running along the length of the monofilament. The next step 7 would be to ensure that the extruded polyester monofilament is properly oriented (drawn) if necessary. Step 8 provides for extruding TPU monofilament without orientation and so that the TPU monofilament has a dimension that plugs into the U-shaped channel of the polyester component. Accordingly, the TPU core or cores, if more than one U-shaped channel is used, are then inserted 9 into the channel(s) of the low melt polyester monofilament. If there is not sufficient bearing or frictional force to maintain the TPU core in the channel, then, if necessary, the bicomponent monofilament structure can be passed through an oven 10 and partially heated to create a bond between the TPU core and the polyester sheath. The so formed U-shaped bicomponent monofilament fiber can now be collected 11 and ultimately incorporated 12 into an industrial fabric or the like.

Note that the bicomponent monofilaments are incorporated into the fabric so that the TPU component is positioned above the monofilament surface and exposed on the paper side of the fabric. Advantageously, the TPU provides improved gripping qualities that enhance sheet restraint and sheet guiding where the fabric is a papermaking fabric. In particular, the bicomponent mono-filaments provide for durable qualities of the type exhibited by fabrics having a coating commercially available from Albany International Corp. under the name AEROGRIP, in dryer fabrics made from such monofilaments.

Improved durability of an AEROGRIP coated product and/or a product coated in accordance with U.S. Pat. No. 5,829,488 is further addressed by a second embodiment of the present invention illustrated in FIGS. 3A-3B. In this regard, certain initial comments are in order. In general, it might be noted that the coating of a papermaking fabric is subject to normal wear during use of the fabric. One mechanism of such wear is the gradual peeling of the coating away from the fabric surface. With the second embodiment of the invention, the life of the AEROGRIP coated product is further extended by mechanically anchoring the coating to the fabric, as described below. This is accomplished using shaped monofilaments incorporated into the fabric. More specifically, the shaped monofilament includes a cavity running along its length that provides a mechanical anchor for the coating that is applied to the fabric.

Figure 3A:
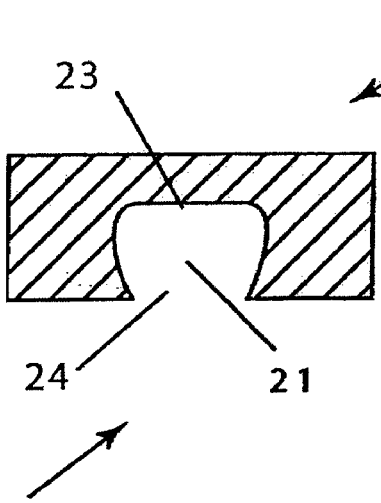
FIGS. 3A-3B are cross sectional views of a second embodiment of the monofilaments of the invention.
Figure 3B:
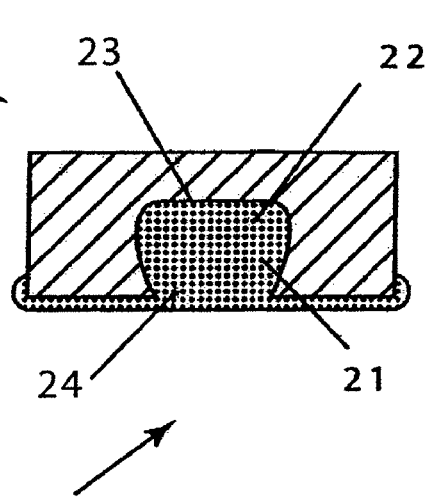

FIG. 3A is a cross sectional view of an example of the shaped monofilament 20 without the coating. In this example, the monofilament 20 has formed therein a single cavity 21. However there may be a plurality of such cavities 21 formed in the monofilament 20. In the example shown in FIG. 3A, the cavity 21 is wider at its bottom 23 than at its open top 24. However cavities having other shapes may be used. FIG. 3B is a cross sectional view of the shaped monofilament 20 having a cavity 21 and also having a coating 22, such as an AEROGRIP coating, applied thereon. The coating 22 fills the cavity 21 and is thereby locked in place by the narrow opening 24 of the cavity 21. Alternatively, a melt-bonded TPU insert may be used to fill the cavity. The thus anchored coating 22 has a further extended life due to its greater resistance to peeling away from the monofilament 20. As FIG. 3B clearly shows, the coating, TPU, or other material is positioned above the surface of the monofilament and will contact, when used for example in paper-making, the sheet goods being produced.

Modifications to the above would be obvious to those of ordinary skill in the art, but would not bring the invention so modified beyond the scope of the appended claims. For example, while certain discussion of the present invention may have referred specifically to dryer fabrics, it has applicability to other belts in the papermaking industry and other industrial applications where coatings are applied. Such applications include, for example, transfer belts and shoe press belts; belts/fabrics used in the commercial production of tissue or towel by the Through Air Drying (TAD) process; and any papermaking or related to papermaking process fabrics/belts which requires a wear or heat resistant coating or extrusion to be placed on the fabric edges. Also, while the AEROGRIP coating has been specifically referred to, the present invention may be utilized with other coatings and impregnates commonly used in industrial applications, as well be apparent to one skilled in the art.

I claim:

1. A forming, press, dryer, TAD, pulp, sludge dewatering, chemiwashers or other engineered fabric comprising a plurality of monofilaments, said monofilaments include at least one longitudinal groove having a bottom and an open top in a paper or nonwoven web contacting or forming surface, wherein said groove is wider at its bottom than at its open top, said plurality of monofilaments positioned in a fabric structure such that said plurality of monofilaments are on said paper or nonwoven web contact or forming surface, said at least one groove comprises a cavity having a closed bottom and an open top running along a length of said groove and a coating applied to said fabric on the paper or nonwoven web contacting or forming surface, said coating filling said at least one groove, and said coating mechanically anchored in and adhered to said groove, said coating having greater resistance to peeling or wearing away from the paper or nonwoven web contacting or forming surface compared to a coated fabric comprising monofilaments without a grooved surface.

2. The fabric of claim 1 wherein said monofilament comprises at least two grooves.

3. The fabric of claim 1 wherein the fabric is taken from the group consisting essentially of woven, spiral wound, knitted, extruded mesh, spiral-linked, spiral coil, and other nonwovens.

4. The fabric of claim 1 wherein the coating is polyurethane.

5. The fabric of claim 1 wherein said coating is applied to at least one of the fabric edges and exhibits wear and heat resistance.

6. The fabric of claim 1 wherein said fabric exhibits improved gripping compared to fabrics constructed of conventional monofilaments.

7. The fabric of claim 6 wherein said fabric exhibits sheet restraint and sheet guiding during papermaking.

* * * * *